United States Patent [19]

Barish

[11] 3,967,756

[45] July 6, 1976

[54] WET WIPE DISPENSER

[75] Inventor: Robert A. Barish, Trenton, N.J.

[73] Assignee: Johnson & Johnson, New Brunswick, N.J.

[22] Filed: June 9, 1975

[21] Appl. No.: 585,006

[52] U.S. Cl. ..... 221/45; 221/63

[51] Int. Cl.[2] ..... A47K 10/24

[58] Field of Search ..... 221/45–63; 206/205; 229/7 R; 220/334, 339

[56] References Cited

UNITED STATES PATENTS

| | | | |
|---|---|---|---|
| 3,784,055 | 1/1974 | Anderson | 221/63 X |
| 3,836,045 | 9/1974 | Duhy | 221/63 |
| 3,843,017 | 10/1974 | Harrison | 221/63 |

*Primary Examiner*—Allen N. Knowles

[57] ABSTRACT

A bottom loading dispensing container for liquid impregnated wipes is disclosed. The top and sides of the container are a single molded plastic element. The top has an opening in its center which is sealed by a removable lid. The container is sealed at the bottom with a liquid impervious element which element may be constructed to add increased dimensional stability to the container.

4 Claims, 5 Drawing Figures

WET WIPE DISPENSER

BACKGROUND OF THE INVENTION

This invention relates to a dispensing container for liquid impregnated disposable towels or wipes. The desirable characteristics of a container of this type are the following:

a. That it be easily filled with the impregnated wipes;
b. That it maintain the liquid in the container during shipment and storage for an extended period of time;
c. That it be reclosable after initial opening; and
d. That the impregnated wipes be readily accessable to the user.

Prior art containers which are effective in preventing liquid from evaporating usually do not allow ready access to the contents of the container. It is often necessary to hold the container in one hand and remove the towels with the other hand. The construction of the present container protects the towels from drying out during shipment and storage and allows ready access to the wipes for use. The package construction also lends itself to being easily filled with towels or wipes in the manufacturing or filling process.

SUMMARY OF THE INVENTION

The container is constructed in four major parts; a body, a reclosable lid, a removable seal and a bottom or base member. The container body is a single molded element comprising the top portion, a front wall, a back wall and end walls. There is an aperture in the top portion of the body, preferably in the center of the top portion. The lower edges of the front, back and end walls extend outwardly from the body forming a continuous flange to which a base or bottom may be attached after the contents have been inserted in the package. There is an indentation or depressed area in the plane of the top portion of the body around the aperture. A neck or lip, adapted to receive a reclosable lid, extends upwardly from the base of the depressed area. There is a space between the neck or lip and the vertical wall of the depression which is of sufficient size to accommodate a horizontal flange of the lid. The neck area defines the aperture through which the impregnated towels are removed from the container. There is a horizontal shoulder spaced inwardly from the neck toward the center of the aperture which is adapted to receive a peelable fluid impervious seal. This seal protects the liquid contents of the container from the evaporation during shipment and storage prior to use.

The molded elements in the container, i.e. the body and the lid, may be fabricated from relatively thin, 40 to 60 mils, plastic material. The dimensional stability of the container may be provided by the base member which is preferably a laminate of paper board, metal foil and a thin plastic film.

BRIEF DESCRIPTION OF THE DRAWINGS

The novel features of the container will become apparent to one skilled in the art with reference to the following drawings in which.

DESCRIPTION OF THE INVENTION

Figure 1:
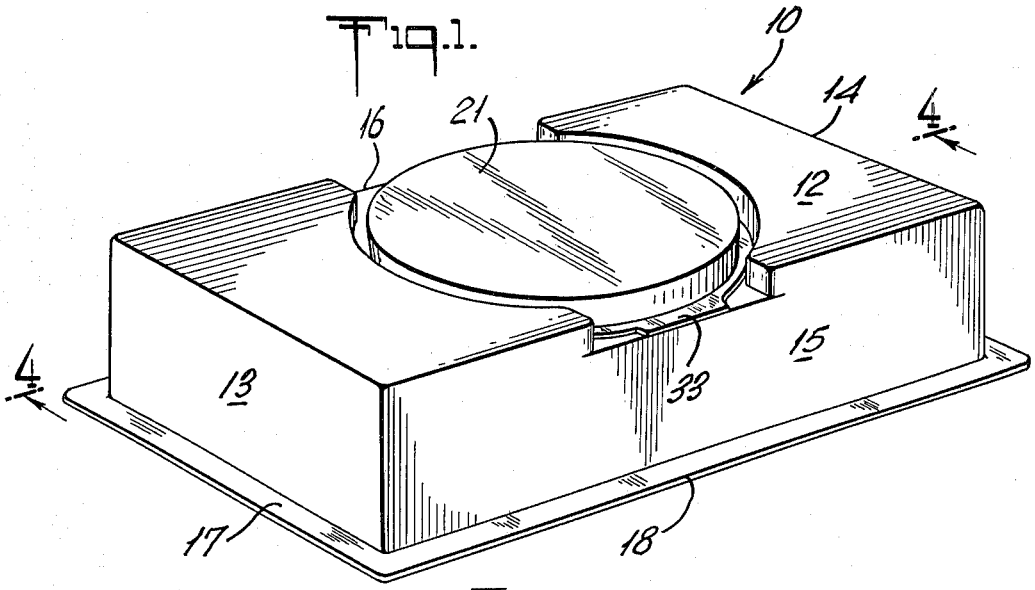
FIG. 1. is an isometric view of the container with the lid in a closed position.

In FIG. 1, the container of the present invention is shown with the lid in a closed position. The container is made with a body portion 10, having an integrally molded top portion 12, end walls 13 and 14, front wall 15 and back wall 16. The body portion may be molded from any suitable plastic material by thermoforming or injection molding techniques. Suitable plastics included polystyrene and high density polyethylene. The thickness of the plastic material in the body portion 10 is from about 40 to about 60 mils. The bottom edge of the container is formed with a flange 17 which is integral with the lower edges of the front, back and end walls of the body. The flange 17 is adapted to have secured thereto a bottom closure element or base 18 which will hereinafter be described.

The top portion 12 has a centrally located indentation, depression or recess 20, into which the lid 21 can be accommodated in the closed position. The depth of the recess 20 is sufficient to allow the closed lid 21 to lay flush with the top portion 12 of the container. This facilitates the shipment of the containers and the stacking of the containers, one on top of another to maximize utilization of shelf space at the point of sale.

Figure 2:
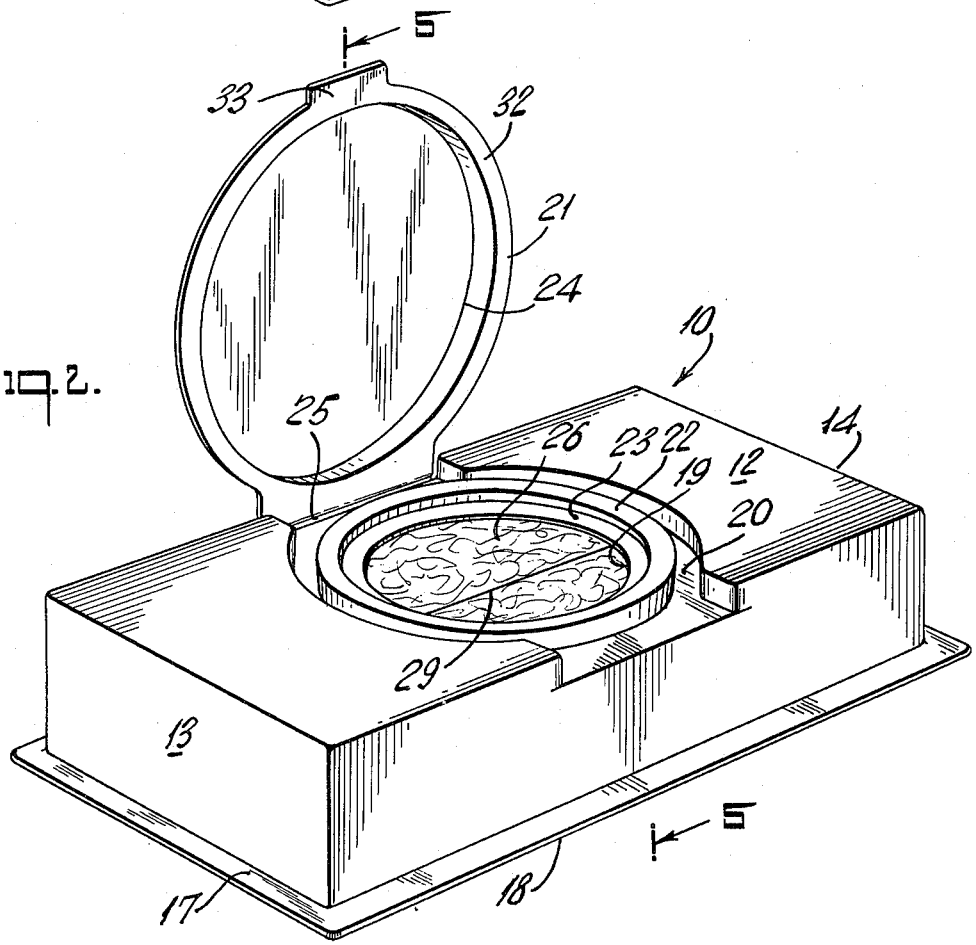
FIG. 2. is an isometric view of the container in an opened position.

In FIG. 2, the container is shown with the lid 21 in an open position. The lid 21 has an interior recess 24 which may be force fit or snap fit around the neck 22 which is integrally formed in the top 12 of the container. The interior recess 24 of the lid fits around the neck 24 and allows the container to be securely closed.

Figure 5:
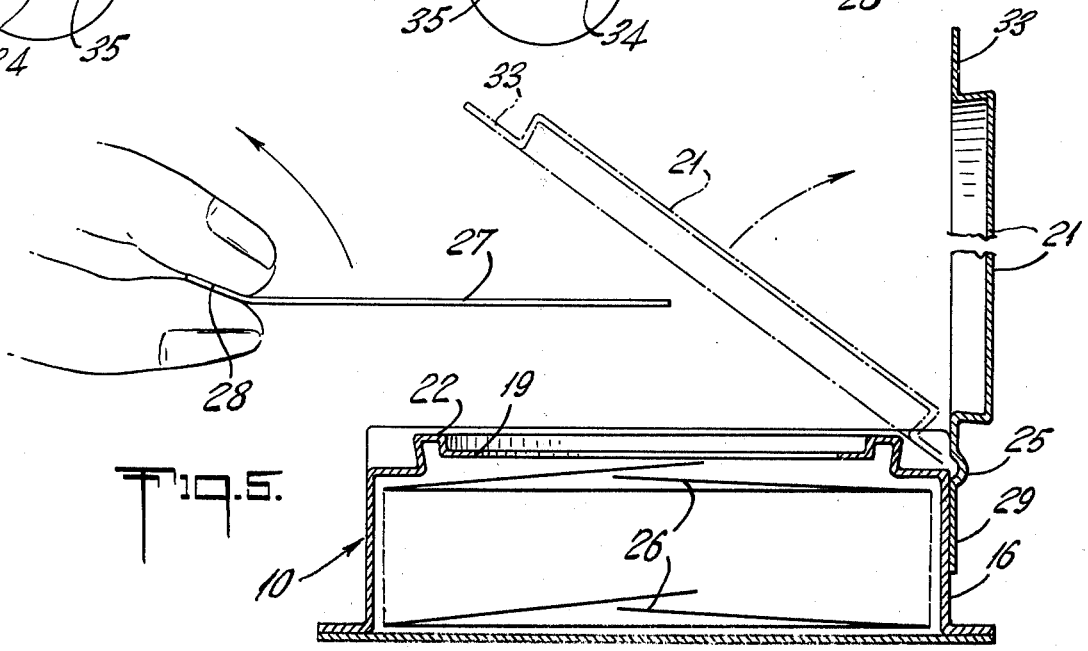
FIG. 5. is a cross-sectional view of the containers taken along lines 5—5 of FIG. 2, showing the removal of the closure in phantom.

As best shown in FIG. 5, the lid 21 is separately formed and attached to the top portion 12 or back wall 16 of the container. As shown, lid 21 has a tab 29 which is secured to the back wall 16 of the body 10. The tab 29 may be secured to the body with adhesive or heat sealed or with any other suitable attachment means. A hinge 25 is molded into the tab 29, and allows the lid to be pivoted into engagement with the neck 22 in the top of the body 10. It should be understood that the lid 21 may be integrally molded with the body by employing a split mold technique which is well known in the art.

Figure 3:
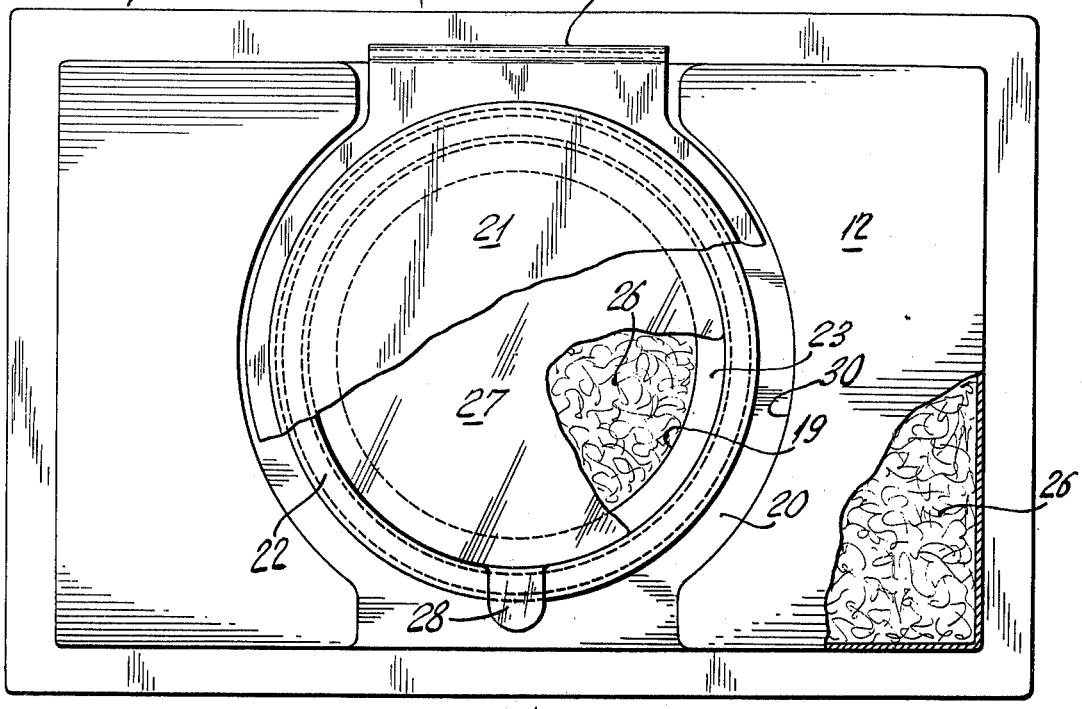
FIG. 3. is a top plan view of the container partially in section.
Figure 4:
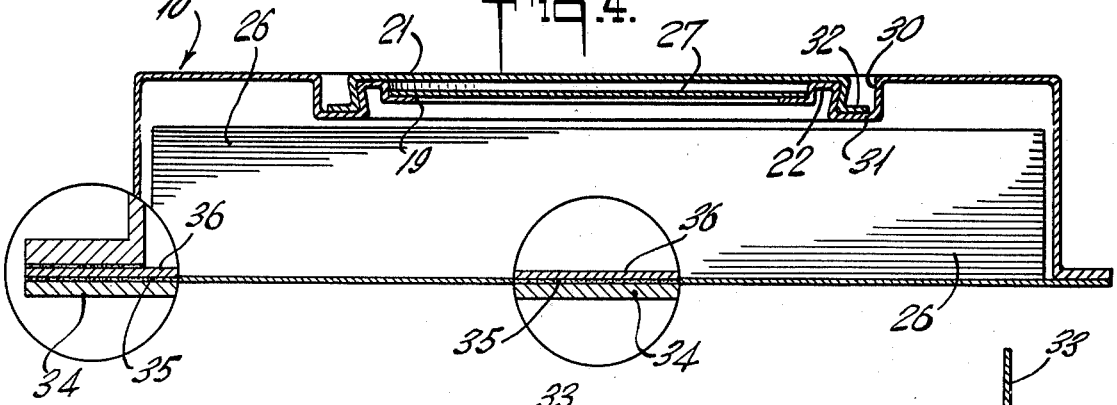
FIG. 4. is a cross-sectional view of the container taken along lines 4—4 of FIG. 1.

As best shown in FIGS. 3 and 4, the top 12 portion has a centrally located aperture 19 through which the impregnated sheets or towels 26 are removed from the container. The indentation or depression in the top portion 12 is formed with a vertically extending wall 30, a horizontal section 31 and the neck 22 extending vertically upward from section 31. The horizontal section 31 is of sufficient width to accommodate the flange portion 32 of the lid 21. The shoulder 23 extends from the rim 22 inwardly into the aperture 19. The shoulder 23 provides a horizontal surface to which a removable seal 27 may be attached to the body of the container. The seal 27 is liquid impervious and protects the liquid contents of the container from evaporation and leakage during shipment and storage. The seal 27 may be plastic film or a metal-foil plastic film laminate. It is secured to the shoulder 23 with a peelable adhesive or heat sealed so that it may be readily removed to gain access to the sheets or towels 26. The seal 27 may have an attached tab 28 to facilitate its removal.

The lower portion or bottom of the front 15, back 16, and end walls 13 and 14 of the body 10 have an outwardly extending flange 17 integrally molded thereto. This flange 17 provides a supporting surface to secure the bottom element or base 18 to the body 10. The bottom element 18 is a liquid impervious plastic, constructed of the same material as the body or may be a laminate of paperboard and metal foil. As best shown in the enlarged areas in FIG. 4, the base is preferably constructed from a laminate of paperboard 34, about 20 to 30 mils thick, an aluminum foil 35, about 0.25 to 0.1 mil. thick, and a plastic film or heat seal coating 36. The film or coating 36 allows the base 18 to be secured to the body by conventional sealing means or by conventional ultrasonic sealing techniques. The paperboard 34 and the foil 35 are secured together with a suitable adhesive. The coating 36 may be applied to the paperboard foil laminate, or if separate film, it may be adhesively secured thereto. If the base 18 is heat sealed to the body 10, it must also comprise a coating or a film of plastic material which may be heat sealed to the plastic material from which the body 10 is fabricated. The base 18 may also be made of a plastic metal foil laminate of from 4 to 5 mils. in thickness. In addition to providing an impervious seal, the bottom element or base 18 also adds to the structural rigidity of the container.

The liquid impregnated sheets or towels 26 may be folded in any manner, such as C folded. They are stacked in the container with an edge 29 exposed to facilitate withdrawal of the sheets one at a time. The sheets are impregnated with a cleaning solution, lotion or medicated solution.

The material from which the towels or sheets are made may be any suitable paper cloth or a nonwoven fabric. The material should be absorbent and have a wet strength which is sufficient for the intended use.

Although the container of the present invention is shown in the drawings in a rectangular configuration, it should be recognized that other geometric designs may be employed. For example, the body 10 may be square or elliptical in shape. Similarly, the aperture 19 may be elliptical rather than circular and may be positioned off-center in the top portion 12 of the container. Other variations in design which do not depart from the invention will be readily apparent to those skilled in the art.

What is claimed is:

1. A dispensing container for stacked sheets comprising a single molded element having a top portion, a front wall, a back wall and two opposing end walls, said top portion being substantially planar from the end walls to a lid receiving depression in said top portion, said lid receiving depression extending from said front wall to said back wall, a neck portion extending upwardly from the base of said depression and having a horizontally extending rim located on a plane no higher than the plane of said top portion, a horizontal shoulder extending inwardly from said neck and an aperture defined by the termination of said shoulder, a reclosable lid adapted to fit over said neck portion, the front, back and end walls having an outwardly extending flange at their lower terminal edge, said flange being continuous around the circumference of said container and a liquid impervious bottom element secured to the flange around its entire circumference to form a continuous seal.

2. The container of claim 1 in which the reclosable lid comprises a tab which is attached to the body of the container.

3. The container of claim 1 in which the bottom element is a laminate of paperboard, aluminum foil and a liquid impervious plastic.

4. The container of claim 1 in which a peelable liquid impervious seal is attached to said shoulder and covers said aperture.

* * * * *